US009623418B2

(12) United States Patent
Dallimore et al.

(10) Patent No.: US 9,623,418 B2
(45) Date of Patent: Apr. 18, 2017

(54) WEAR TIP HOLDER FOR VSI CRUSHER, AND METHOD OF REDUCING WEAR OF VSI CRUSHER ROTOR

(75) Inventors: Rowan Dallimore, Somerset (GB); Knut Kjaerran, Svedala (SE); Andreas Forsberg, Malmo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/346,336

(22) PCT Filed: Aug. 29, 2012

(86) PCT No.: PCT/EP2012/066745

§ 371 (c)(1),
(2), (4) Date: Mar. 21, 2014

(87) PCT Pub. No.: WO2013/041333

PCT Pub. Date: Mar. 28, 2013

(65) Prior Publication Data

US 2014/0217207 A1 Aug. 7, 2014

(30) Foreign Application Priority Data

Sep. 23, 2011 (EP) ..... 11182565

(51) Int. Cl.
*B02C 13/28* (2006.01)
*B02C 13/18* (2006.01)

(52) U.S. Cl.
CPC ..... *B02C 13/1842* (2013.01); *B02C 13/2804* (2013.01)

(58) Field of Classification Search
CPC ..... B02C 13/1842; B02C 13/2804; B02C 13/1835; B02C 2/10; B02C 13/095; B02C 13/1814

(Continued)

(56) References Cited

U.S. PATENT DOCUMENTS 3,058,679 A * 10/1962 Adams ..... 241/275
3,074,657 A * 1/1963 Bridgewater ..... 241/275

(Continued)

FOREIGN PATENT DOCUMENTS

CN 202638483 U 1/2013
WO 2004020104 A1 3/2004
WO 2008133568 A1 11/2008

*Primary Examiner* — Faye Francis
*Assistant Examiner* — Onekki Jolly
(74) *Attorney, Agent, or Firm* — Corinne R. Gorski

(57) ABSTRACT

A wear tip holder for holding a wear tip adjacent to an outflow opening of a vertical rotor wall of a rotor of a VSI crusher includes a mounting plate for mounting the wear tip holder to the rotor wall. The mounting plate has a mounting face for facing the rotor wall to which it is to be mounted, and opposite the mounting face, a wear face for facing the interior of the rotor. A wear body is connected to the mounting plate and is provided with an elongate wear tip recess for holding the wear tip. At least one material retention groove extends along the wear tip recess at a position upstream, as seen in a direction of an intended flow of material to be crushed, of the wear tip recess. The material retention groove has an upstream groove wall and a downstream groove wall, the downstream groove wall forming an acute angle with the wear face for retaining material to be crushed.

11 Claims, 7 Drawing Sheets

(58) Field of Classification Search
USPC ..... 241/275, 294, 300
See application file for complete search history.

(56) References Cited

U.S. PATENT DOCUMENTS

| | | | | | |
|---|---|---|---|---|---|
| 3,162,386 | A * | 12/1964 | Danyluke | ..... | 241/275 |
| 4,787,564 | A * | 11/1988 | Tucker | ..... | 241/275 |
| 4,896,838 | A * | 1/1990 | Vendelin et al. | ..... | 241/275 |
| 6,405,953 | B1 * | 6/2002 | Warren | ..... | 241/275 |
| 6,554,215 | B1 * | 4/2003 | Schultz et al. | ..... | 241/275 |
| 2006/0163400 | A1 * | 7/2006 | Dallimore et al. | ..... | 241/275 |
| 2008/0265075 | A1 * | 10/2008 | Dallimore et al. | ..... | 241/300 |

* cited by examiner

WEAR TIP HOLDER FOR VSI CRUSHER, AND METHOD OF REDUCING WEAR OF VSI CRUSHER ROTOR

RELATED APPLICATION DATA

This application is a §371 National Stage Application of PCT International Application No. PCT/EP2012/066745 filed Aug. 29, 2012 claiming priority of EP Application No. 11182565.9, filed Sep. 23, 2011.

FIELD OF THE INVENTION

The present invention relates to a wear tip holder for holding a wear tip adjacent to an outflow opening of a vertical rotor wall of a rotor of a VSI crusher. The invention also relates to a method of reducing the wear rate of such a rotor.

BACKGROUND OF THE INVENTION

Vertical shaft impact crushers (VSI crushers) are used in many applications for crushing hard material, such as rocks, ore etc. A VSI crusher comprises a housing and a horizontal rotor located inside the housing. WO 2008133568 (A1) discloses an example of a rotor of a VSI crusher. Material that is to be crushed is vertically fed into the rotor, and with the aid of centrifugal force the rotating rotor ejects the material against the inner wall of the housing. On impact with the wall of the housing the material is crushed to a desired size. The housing wall could be provided with anvils or have a bed of retained material against which the accelerated material is crushed.

The rotor of a VSI crusher usually has a horizontal upper disc and a horizontal lower disc. The upper disc has an aperture for feeding material to be crushed into the rotor, such that the material lands on the lower disc. The upper and lower discs are interconnected by a vertical rotor wall, which guides the material to material outflow openings about the circumference of the rotor. The vertical rotor wall of WO 2008133568 is provided with a number of wear tips adjacent to the outflow openings in the rotor wall, to protect the rotor wall from wear caused by the material leaving the rotor at a high speed. The wear tips are provided with air flow directing ridges for reducing the wear of the wear tips and the rotor wall.

When the wear tips have become worn out they must be replaced. Replacement of the wear parts requires the VSI crusher to be shut down for a considerable time for maintenance.

SUMMARY OF THE INVENTION

It is an object of the present invention to solve, or at least mitigate, parts or all of the above mentioned problems. To this end, there is provided a wear tip holder for holding a wear tip adjacent to an outflow opening of a vertical rotor wall of a rotor of a VSI crusher, said wear tip holder comprising a mounting plate for mounting the wear tip holder to said rotor wall; and a wear body, connected to said mounting plate, the wear body being provided with an elongate wear tip recess for holding the wear tip, and the mounting plate having a mounting face for facing the rotor wall to which it is to be mounted; and, opposite the mounting face, a wear face for facing the interior of the rotor, wherein the wear tip holder comprises at least one material retention groove extending along the wear tip recess at a position upstream, as seen in a direction of an intended flow of material to be crushed, of the wear tip recess, the material retention groove having an upstream groove wall and a downstream groove wall, said downstream groove wall forming an acute angle with the wear face for retaining material to be crushed. When such a wear tip holder is used in a VSI crusher, material to be crushed may become trapped in the material retention groove. The trapped material will assist in forming and maintaining a bed of material on the rotor wall and on the wear tip holder, such that the wear of the rotor wall, wear tip holder, and wear tip will be reduced. Thanks to the acute angle, material to be crushed is wedged in the retention groove by the downstream groove wall. Thereby, the acute angle reduces the risk that the bed of material slides off the rotor wall and exposes the rotor wall/wear tip holder/wear tip to wear. As a consequence, an increase of the service interval of the crusher may be allowed.

According to an embodiment, said acute angle is sharper than 70°. Such a design increases the material trapping and retention efficiency of the material retention groove.

According to an embodiment, said at least one material retention groove comprises a material retention groove formed in the wear body between the mounting plate and the wear tip recess. Due to the adjacency of the material retention groove to the wear tip recess, the bed of material may more efficiently protect the wear tip from wear.

According to an embodiment, the material retention groove is located at a shortest distance from the wear tip recess of less than 50 mm.

According to an embodiment, said at least one material retention groove comprises a material retention groove formed in the wear face of the mounting plate. The material retention groove formed in the wear face of the mounting plate may also be combined with a material retention groove formed in the wear body between the mounting plate and the wear tip recess.

According to an embodiment, the material retention groove extends along at least ⅓ of the length of the wear tip recess. Such a design increases the material trapping and retention efficiency of the material retention groove.

According to an embodiment, the upstream groove wall slopes towards a plane defined by the mounting face. Thereby, the material retention groove will be at least partly countersunk into the wear tip holder, such that the material retention groove is protected from excessive wear.

According to an embodiment, the upstream groove wall slopes from a surface essentially flush with the wear face. Such a design increases the material trapping efficiency of the material retention groove.

According to an embodiment, the upstream groove wall forms an angle with the wear face of less than 45°. Such a design increases the material trapping efficiency of the material retention groove.

According to an embodiment, a surface portion of the wear body located between the material retention groove and the wear tip recess is essentially flush with the wear face. Such a design concentrates the wear to the wear-resistant wear tip, thereby increasing the life expectancy of the wear tip holder.

According to an embodiment, the downstream groove wall has a width of less than 70% of the width of the upstream groove wall. Such a design provides the wear tip holder with an appropriate balance between durability and material trapping/retention ability.

According to another aspect of the invention, parts or all of the above mentioned problems are solved, or at least mitigated, by a method of decreasing the wear rate of a rotor of a VSI crusher, the rotor comprising a wear tip holder holding a wear tip onto a rotor wall, the wear tip holder comprising a mounting plate having a mounting face facing the rotor wall to which it is mounted; and, opposite the mounting face, a wear face facing the interior of the rotor, the method comprising trapping material to be crushed in a material retention groove extending along the wear tip at a position upstream, as seen in a direction of an intended flow of material to be crushed, of the wear tip, the material retention groove having an upstream groove wall and a downstream groove wall, said downstream groove wall forming an acute angle with the wear face of the mounting plate. Using such a method, material to be crushed is wedged upstream of the wear tip. Thereby, the risk is reduced that the bed of material slides off the rotor wall and exposes the rotor wall/wear tip holder/wear tip to wear. As a consequence, an increase of the service interval of the crusher may be allowed.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF THE EXEMPLARY EMBODIMENTS

Figure 1:
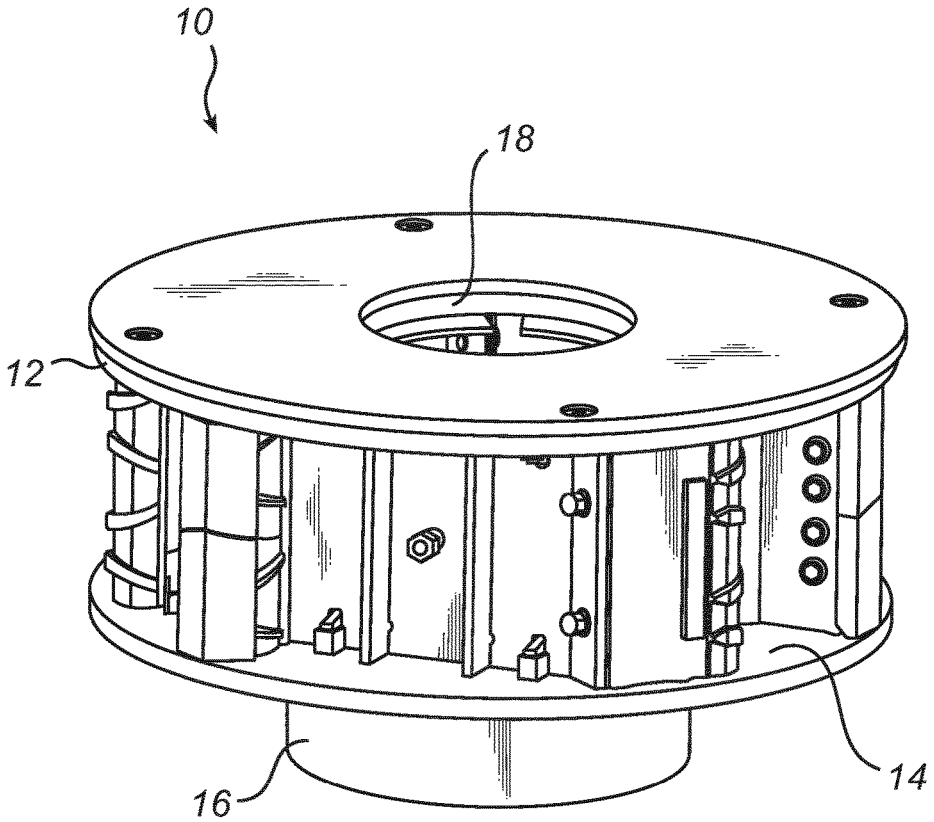
FIG. 1 is a three-dimensional view and shows a rotor for a VSI crusher.

FIG. 1 shows a rotor 10 for use in a Vertical Shaft Impact Crusher, i.e., a VSI crusher. The rotor 10 has a roof in the form of a horizontal upper disc 12, and a floor in the form of a horizontal lower disc 14. The lower disc 14 has a hub 16, which is welded to the disc 14. The hub 16 is to be connected to a shaft (not shown) for rotating the rotor 10 inside the housing of a VSI crusher. The upper disc 12 has a central aperture 18 through which material to be crushed can be fed into the rotor 10.

Figure 2:
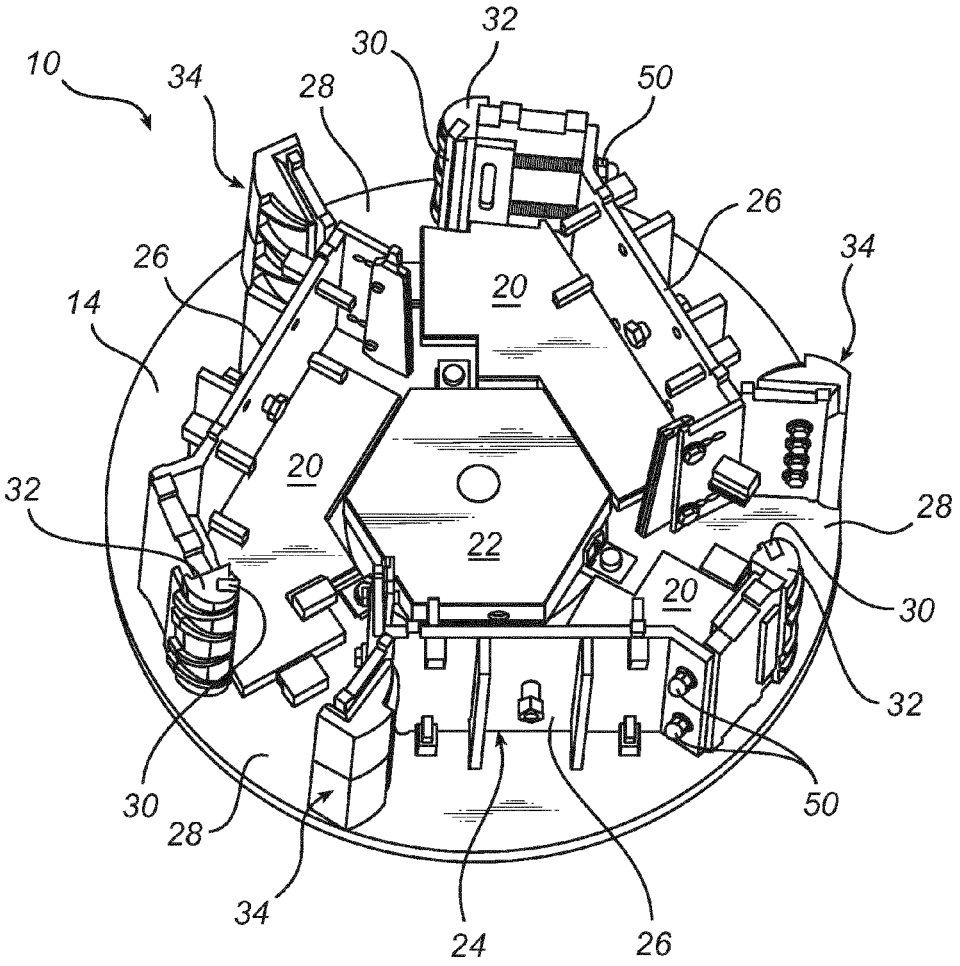
FIG. 2 is a three-dimensional view and shows the rotor of FIG. 1 with the upper disc removed.

As is shown in FIG. 2 the lower disc 14 is protected from wear by lower wear plates 20. A distributor plate 22 is fastened to the centre of the lower disc 14. The distributor plate 22 distributes the material that is fed via the aperture 18 in the upper disc 12 (FIG. 1).

The upper and lower discs 12, 14 are separated by and held together by a vertical rotor wall 24, which is separated into three separate wall segments 26. Gaps between the wall segments 26 define outflow openings 28, through which material may be ejected against a housing wall (not shown). At each outflow opening 28 the respective wall segment 26 is protected from wear by a wear tip 30 located at the leading edge of the respective wall segment 26. Each wear tip 30 is mounted to the respective wall segment 26 by means of a wear tip holder 32, which will be described further below. Each wall segment 26 is also provided with a respective pair 34 of cavity wear plates, which protect the rotor 10 and in particular the wear tips 30 from material rebounding from the housing wall and from ejected material and airborne fine dust spinning around the rotor 10.

Figure 3:
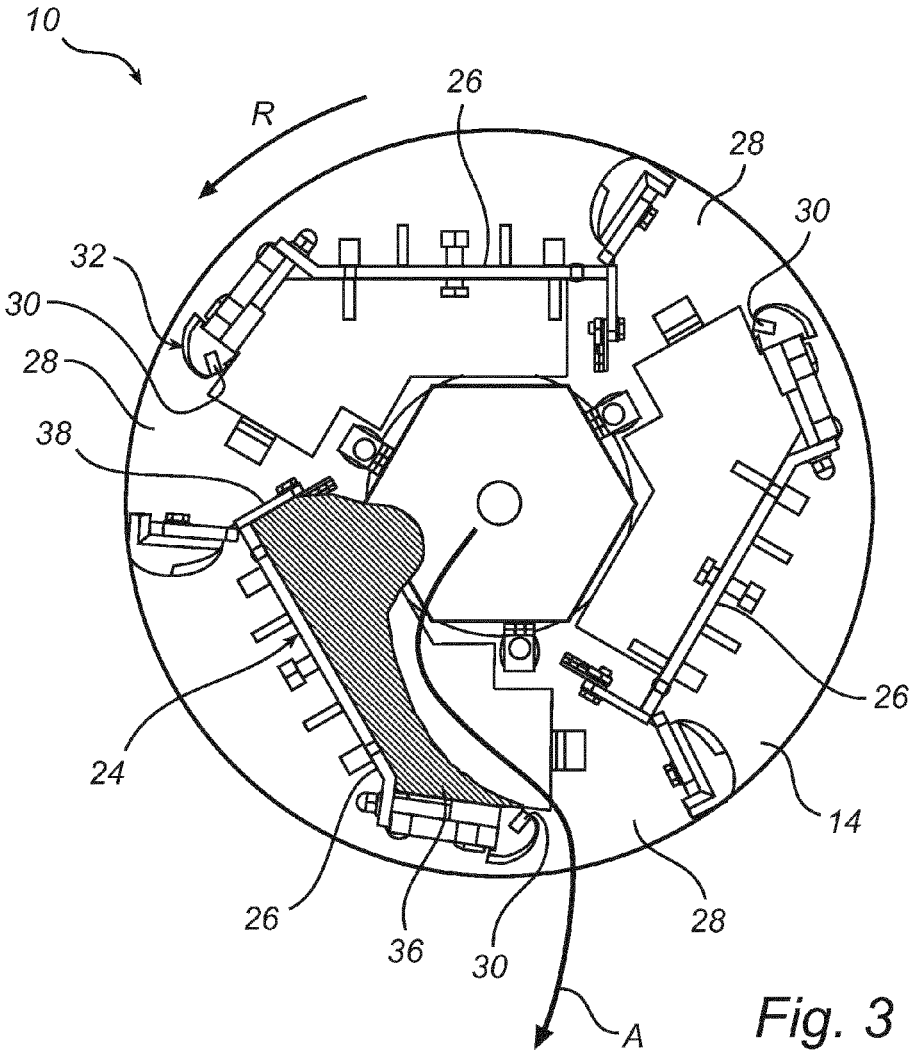
FIG. 3 shows the view of FIG. 2 as seen from above in a two dimensional perspective.

FIG. 3 illustrates the rotor 10 as seen from above and in operation. The upper disc 12 is not shown in FIG. 3 for reasons of clarity. The arrow R indicates the rotational direction of the rotor 10 during operation of the VSI crusher. During operation of the rotor 10 a bed 36 of material is built up inside the rotor 10 against each of the three wall segments 26. In FIG. 3 only the bed 36 located adjacent to one of the wall segments 26 is shown. The bed 36, which consists of material that has been fed to the rotor 10 and then has been trapped inside it, extends from a rear support plate 38 to the wear tip 30. The bed 36 protects the wall segment 26 and the wear tip 30 from wear and provides a proper direction to the ejected material. The bed 36 of material forms an autogenous wear surface, which is regenerated as more material is fed into the crusher. The arrow A describes a typical passage of a piece of rock fed to the rotor 10 via the central aperture 18 and ejected via an outflow opening 28.

Figure 4A:
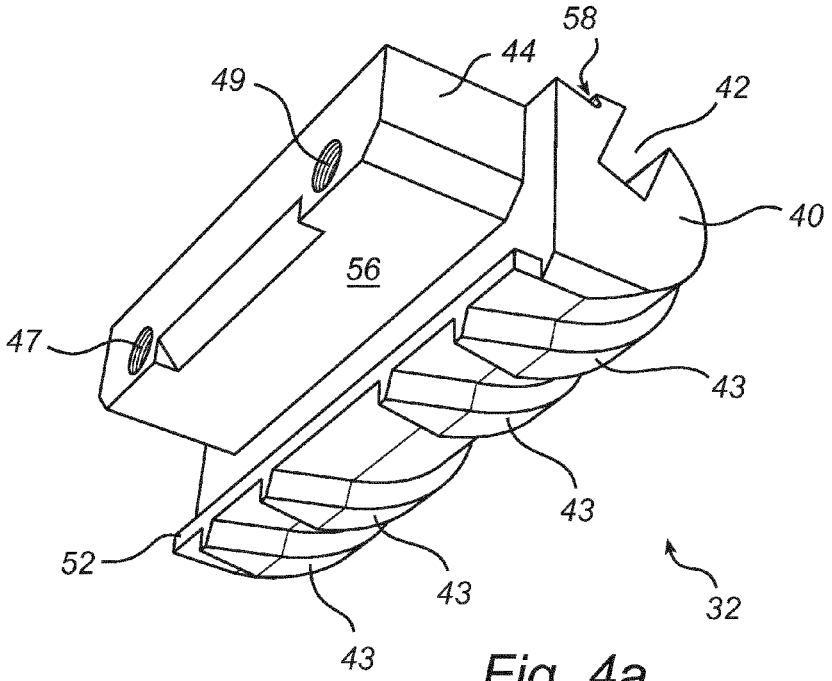
FIG. 4*a* is a three-dimensional view of a wear tip holder according to a first embodiment.
Figure 4B:
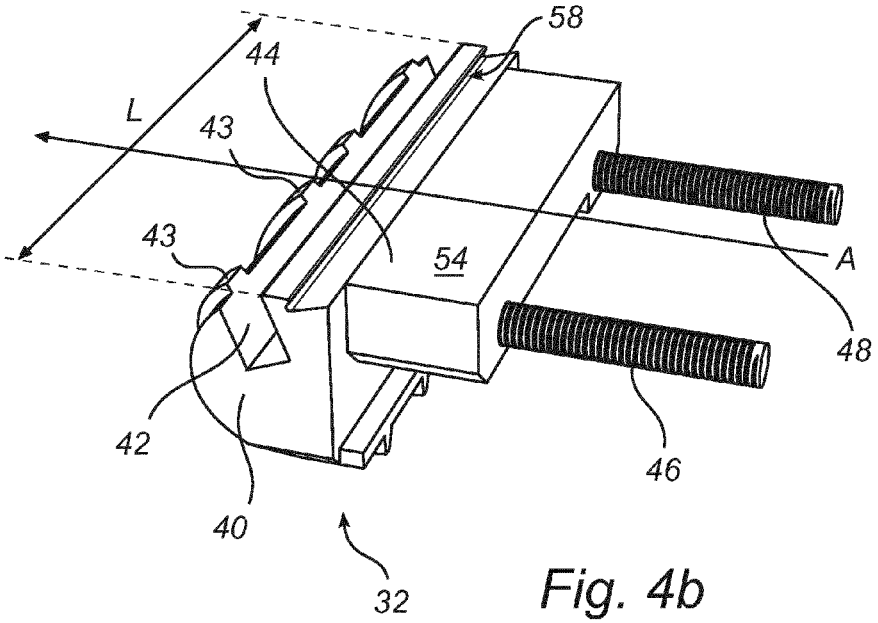
FIG. 4*b* is a further three-dimensional view of the wear tip holder of FIG. 4*a;*

FIGS. 4*a* and 4*b* illustrate a first embodiment of a wear tip holder 32. The wear tip holder 32 has a wear body 40 with an elongate wear tip recess 42, in which the wear tip 30 (FIG. 2) is to be located. The wear tip 30, which typically comprises a hard material such as tungsten carbide, may, by way of example, be welded or glued to the wear tip recess 42. Ridges 43 extend across the wear body 40, and serve for forming an irregular turbulent air flow adjacent to the wear tip 30 in the manner described in greater detail in WO 2008/133568, such that the abrasive effect of dust laden air flowing past the wear tip 30 will be minimized.

The wear tip recess 42 and wear tip 30 (FIG. 2) extend, when the wear tip holder 32 is mounted to a horizontal rotor 10 (FIGS. 1-3), in a vertical direction along the wear body 40.

A mounting plate 44, which is a flat, rectangular plate for mounting the wear tip holder 32 to a vertical wall segment 26 of the rotor 10, is attached to the wear body 40. Two threaded bars 46, 48 (FIG. 4*b*) extend from one end of the mounting plate 44. By means of these two bars 46, 48 the wear tip holder 32 can be mounted to the wall segment 26 and fixed by nuts 50 (FIG. 2). FIG. 4*a* illustrates the wear tip holder 32 without the threaded bars 46, 48, instead revealing a pair of threaded holes 47, 49 for receiving the threaded bars 46, 48 of FIG. 4*b*. A holding flange 52, extending from the wear body 40 at a distance from and in the same general direction as the mounting plate 44, serves for gripping and holding the wall element 26 in a manner which will be illustrated in greater detail in FIG. 5. Referring again to FIGS. 4*a-b*, the mounting plate has a wear face 54 (FIG. 4*b*), which, when the wear tip holder 32 is attached to the rotor wall 24, faces the interior of the rotor 10, and which is exposed to wear at any location where it is not protected by the bed 36 of material (FIG. 3). The mounting plate 44 also has a mounting face 56 (FIG. 4*a*), which abuts the surface of the wall element 26 when the wear tip holder 32 is attached to the wall 24.

When the wear tip holder 32 is in use, material to be crushed flows along the path illustrated by the arrow A of FIG. 4*b*.

A material retention groove 58 runs along the wear body 40, i.e., when the wear tip holder 32 is mounted in a VSI crusher, in an essentially vertical direction. It runs along the entire length of the wear body 40, such that the length of the material retention groove 58 corresponds to the length L of the wear tip recess 42. The material retention groove 58 is located between the wear tip recess 42 and the wear face 54 of the mounting plate 44, i.e., referring to the flow direction A, upstream of the wear tip recess 42. The material retention groove 58 serves for retaining material to be crushed, such that a bed 36 of material may easier be built up on the wear tip holder 32 and the rotor wall 24. In the embodiment illustrated in FIGS. 4*a*-*b*, the material retention groove is located adjacent to the wear tip groove, and material trapped therein thereby also efficiently protects the wear tip 30 (FIG. 2), immediately downstream of the material retention groove 58, from impact of material flowing along the path A.

Figure 5:
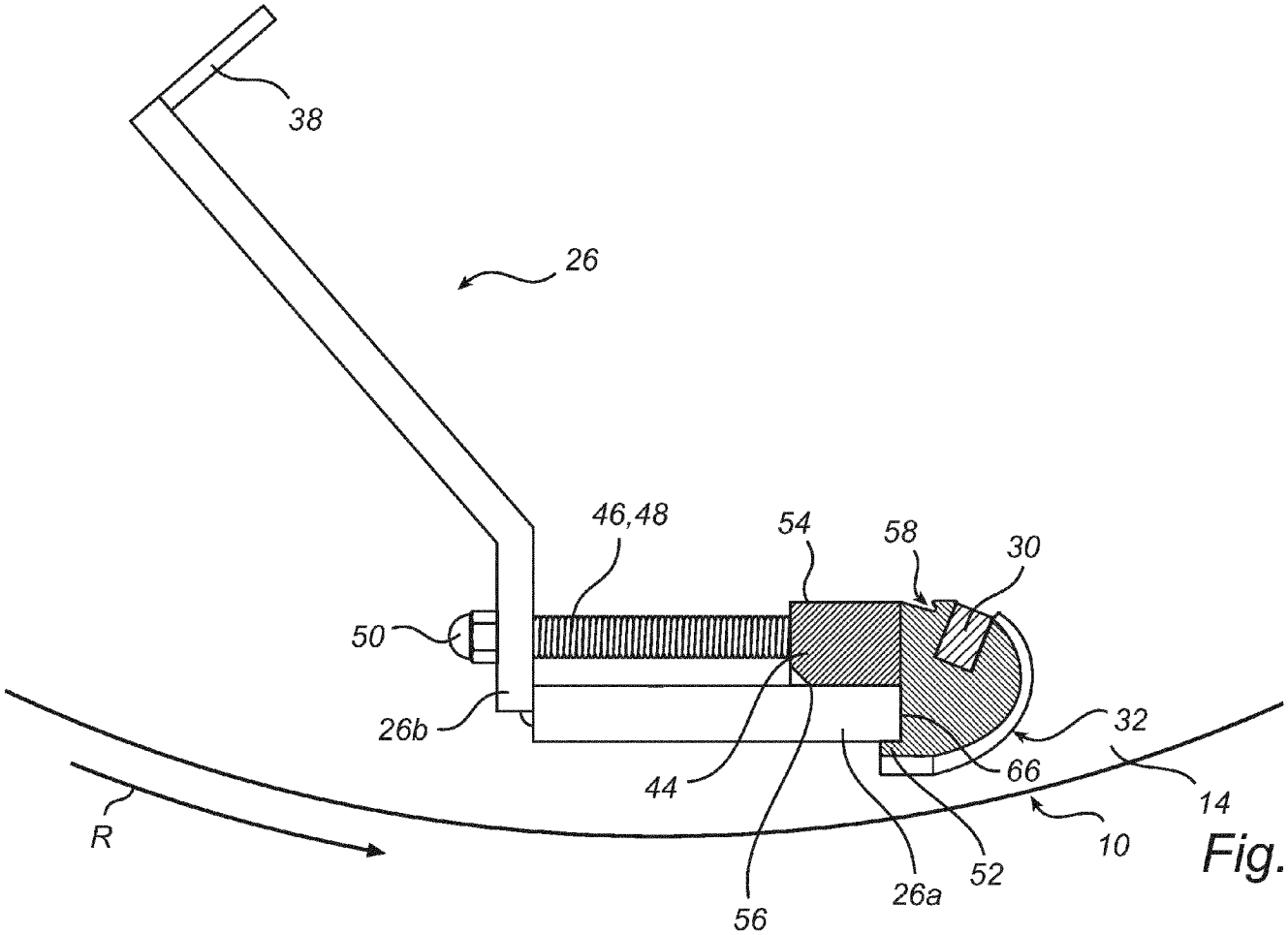
FIG. 5 is a diagrammatic view in section, as seen from above, of a detail of the rotor of FIG. 3 as equipped with the wear tip holder of FIGS. 4*a-b;*

The top view of FIG. 5 illustrates how the wear tip holder 32, when in use, is mounted to a rotor wall segment 26. The mounting face 56 of the mounting plate 44 rests on, and abuts, a first portion 26*a* of the rotor wall segment 26 in such a manner that the holding flange 52 of the wear tip holder 32 grips an edge 66 of the wall segment 26. The threaded bars 46, 48 penetrate a second portion 26*b* of the wall segment, and nuts 50 are tightened on the threaded bars 46, 48 such that the holding flange 52 firmly grips the wall segment 26.

Figure 6A:
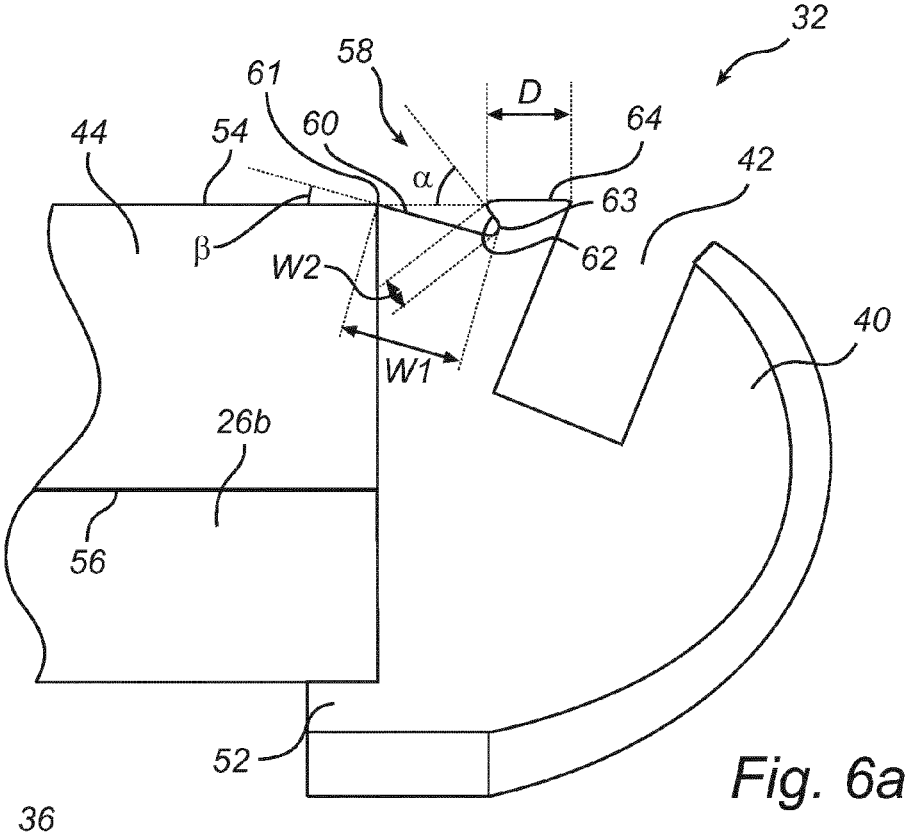
FIG. 6*a* is a diagrammatic view in section, as seen from above, of a detail of the wear tip holder of FIGS. 1-5 as mounted onto a rotor wall segment.

The magnified cross-section of FIG. 6*a* in greater detail illustrates the shape of the wear tip holder 32 adjacent to the material retention groove 58. The material retention groove 58 is located at a distance D from the wear tip recess 42, and is formed by an upstream groove wall 60 and a downstream groove wall 62, upstream and downstream again referring to an intended flow direction of material. The upstream groove wall 60 slopes from a position 61, which is flush with the wear face 54 of the mounting plate 44, obliquely towards the plane defined by the mounting face 56. In this manner, the upstream groove wall 60 forms a lightly sloping entry surface for guiding material to be crushed into the material retention groove 58. Preferably, the upstream groove wall 60 forms an angle β with the wear face 54 of less than 45°, and more preferred, of less than 30°. Such an angle facilitates for material to enter the material retention groove 58.

The downstream groove wall 62 forms an angle α with the wear face 54 of the mounting plate 44, said angle α being acute, i.e. sharper than 90°, such that the downstream groove wall 62 will guide parts of the material to be crushed, flowing across the wear face 54, into the material retention groove 58. Thereby, as material flows along the path A (FIG. 4*b*), parts of it will become trapped in the material retention groove 58. Thanks to the acute inclination a of the downstream groove wall 62 relative to the wear face 54, and relative to the flow direction A, the material will be trapped and firmly wedged in the material retention groove 58, such that the bed 30 of material built up upstream of the material retention groove 58 will be less prone to slide off the rotor wall segment 26.

In the illustrated embodiment, the upstream groove wall 60 has a width W1 which is larger than the width W2 of the downstream groove wall. The upstream and downstream groove walls 60, 62 meet at a groove bottom 63, such that the upstream and downstream groove walls 60, 62 together form a material retention groove 58 which is essentially V-shaped.

A surface portion 64 of the wear body 40, located between the material retention groove 58 and the wear tip recess 42, is essentially flush with the wear face 54, so as to minimize the wear of the wear body 40 upstream of the wear tip recess 42; instead, wear is concentrated to the wear tip 30 (FIG. 2).

Figure 6B:
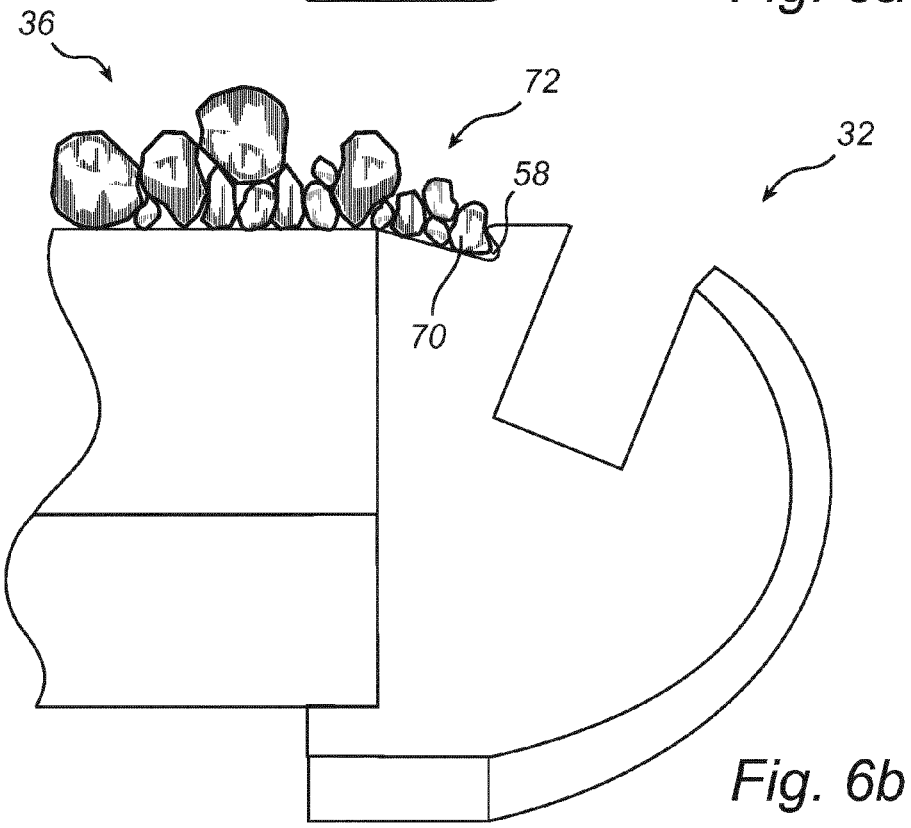
FIG. 6*b* is a diagrammatic view corresponding to the view of FIG. 6*a*, illustrating the wear tip holder when material to be crushed is present in the crusher.

FIG. 6*b* illustrates the function of the material retention groove 58 when the crusher is operated with material to be crushed is present in the rotor 10. The figure illustrates how pieces 70 of material to be crushed, e.g. pieces of rock, have, by operating the crusher, been trapped in the material retention groove 58, and thanks to the centrifugal force acting on the pieces 70 of material, the pieces 70 may be stuck firmly to the material retention groove 58 for as long as the crusher is operated. The pieces 70 of material form a rough, structured surface 72 facing the interior of the rotor 10, thereby assisting in preventing the bed 36 of material from sliding across the wear tip 30 and leaving the rotor 10.

Furthermore, the adjacency of the material retention groove 58 to the wear tip recess 42 assists in extending the bed 36 of material very close to the wear tip 30, thereby efficiently protecting also the wear tip 30 (FIG. 5) from wear. Preferably, the distance D (FIG. 6*a*) is less than 50 mm.

Figure 7:
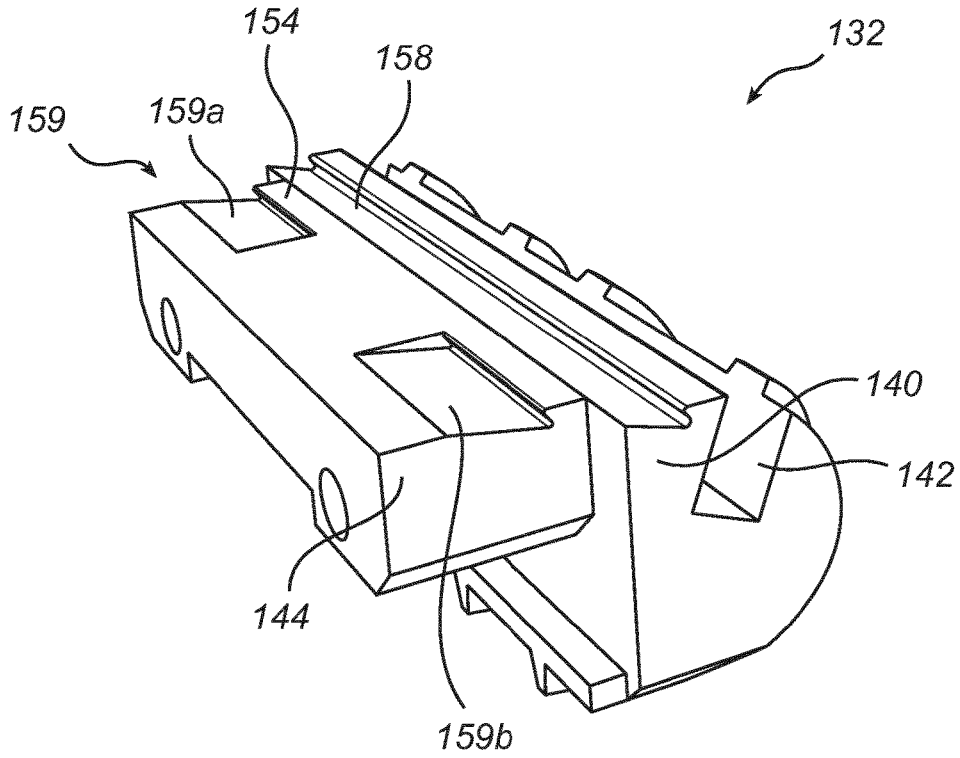
FIG. 7*is* a three-dimensional view of a wear tip holder according to a second embodiment.

FIG. 7 illustrates a second embodiment of a wear tip holder 132 in perspective. The wear tip holder 132 comprises a wear body 140 with a wear tip recess 142, and a mounting plate 144 for mounting the wear tip holder 132 to a rotor wall segment 26 (FIG. 5). Similar to the embodiment of FIGS. 1-6, the wear body 140 is provided with a first material retention groove 158. The embodiment of FIG. 7 however differs from the embodiment of FIGS. 1-6 in that the wear tip holder 132 is also provided with a second material retention groove 159 arranged in the wear face 154 of the mounting plate 144. The second material retention groove 159 is formed by two separate material retention groove segments 159*a*, 159*b*, which extend along a line parallel to the wear tip recess 142. Similar to the first material retention groove 158, each of the groove segments 159*a*-*b* of the second material retention groove 159 is formed by an upstream groove wall and a downstream groove wall. The respective downstream groove walls of the material retention groove segments 159*a*-*b* form a respective angle α (c.f. FIG. 6*a*) with the wear face 154 of the mounting plate 144, said angle α being sharper than 90°. Thereby, the second material retention groove 159 will retain material to be crushed in the same manner as the first material retention groove 158.

The upstream groove walls of the material retention groove segments 159*a*-*b* also form a respective angle β (again, c.f. FIG. 6*a*) with the wear face 154 of less than 45°, and more preferred, of less than 30°.

The invention has mainly been described above with reference to a few embodiments. However, as is readily appreciated by a person skilled in the art, other embodiments than the ones disclosed above are equally possible within the scope of the invention, as defined by the appended patent claims.

For example, also a downstream groove wall which has, as seen in a cross-section corresponding to the view of e.g. FIG. 6*a*, a curved shape, will at least at a portion thereof form an acute angle α with the wear face of the mounting plate. The same applies, mutatis mutandis, to the upstream groove wall and the angle β.

Moreover, the invention is not limited to any particular number of material retention grooves in a single wear tip holder, or to any particular size or shape of the material retention groove(s) other than those limitations imposed by the features of the appended claims. Many different groove sizes and groove shapes are suitable for retaining, when the wear tip holder is in use, material to be crushed. All such embodiments fall within the scope of the appended claims.

The invention claimed is:

1. A vertical shaft impact crusher (VSI) for crushing material, the VSI crusher comprising:

a rotor having a vertical rotor wall; and a wear tip holder arranged to hold a wear tip adjacent to an outflow opening of the vertical rotor wall, said wear tip holder including a mounting plate for mounting the wear tip holder to the vertical rotor wall of the rotor; a wear body connected to said mounting plate, the wear body having an elongate recess arranged to receive the wear tip to hold the wear tip adjacent to the outflow opening, the mounting plate having a mounting face abutting the rotor wall and, opposite the mounting face, a wear face facing an interior of the rotor; and at least one material retention groove extending along the wear tip recess at a position upstream, as seen in a direction of a flow of material to be crushed, of the wear tip recess, the material retention groove opening into the interior of the rotor into the flow of material to be crushed and having an upstream groove wall and a downstream groove wall, said downstream groove wall forming an acute angle with the wear face for trapping the material to be crushed in said material retention groove.

2. The VSI crusher according to claim 1, wherein said acute angle is sharper than 70°.

3. The VSI crusher according claim 1, wherein said at least one material retention groove is formed in the wear body between the mounting plate and the wear tip recess.

4. The VSI crusher according to claim 1, wherein the material retention groove is located at a distance from the wear tip recess, the distance being less than 50 mm.

5. The VSI crusher according to claim 1, wherein said at least one material retention groove is formed in the wear face of the mounting plate.

6. The VSI crusher according to claim 1, wherein the at least one material retention groove extends along at least ⅓ of a length of the wear tip recess.

7. The VSI crusher according to claim 1, wherein the upstream groove wall slopes towards a plane defined by the mounting face.

8. The VSI crusher according to claim 1, wherein the upstream groove wall forms a surface flush with the wear face.

9. The VSI crusher according to claim 1, wherein the upstream groove wall forms an angle with the wear face of less than 45°.

10. The VSI crusher according to claim 1, wherein a surface portion of the wear body is located between the material retention groove and the wear tip recess, the surface portion being flush with the wear face.

11. The VSI crusher according to claim 1, wherein the downstream groove wall has a width of less than 70% of a width of the upstream groove wall.

* * * * *